US008682233B2

(12) United States Patent
deJong et al.

(10) Patent No.: US 8,682,233 B2
(45) Date of Patent: Mar. 25, 2014

(54) BELT TRACKING USING STEERING ANGLE FEED-FORWARD CONTROL

(75) Inventors: Joannes N. M. deJong, Hopewell Junction, NY (US); Lloyd A. Williams, Mahopac, NY (US)

(73) Assignee: Xerox Corporation, Norwalk, CT (US)

( * ) Notice: Subject to any disclaimer, the term of this patent is extended or adjusted under 35 U.S.C. 154(b) by 167 days.

(21) Appl. No.: 13/282,061

(22) Filed: Oct. 26, 2011

(65) Prior Publication Data

US 2013/0108334 A1 May 2, 2013

(51) Int. Cl.
*G03G 15/00* (2006.01)
*G03G 15/16* (2006.01)

(52) U.S. Cl.
USPC ..... 399/313; 399/302

(58) Field of Classification Search
USPC ..... 399/312, 313, 303, 302, 308, 162, 165, 399/167; 198/807, 810.3
See application file for complete search history.

(56) References Cited

U.S. PATENT DOCUMENTS

| | | | | |
|---|---|---|---|---|
| 5,225,877 | A | 7/1993 | Wong | |
| 5,510,877 | A * | 4/1996 | deJong et al. | 399/165 X |
| 5,515,139 | A | 5/1996 | Hou et al. | |
| 5,519,230 | A | 5/1996 | Hubble, III et al. | |
| 5,565,965 | A | 10/1996 | Costanza et al. | |
| 6,594,460 | B1 | 7/2003 | Williams et al. | |
| 6,600,507 | B2 | 7/2003 | Sanchez et al. | |
| 8,112,021 | B2 * | 2/2012 | Mochizuki | 399/302 |
| 2010/0189475 | A1 * | 7/2010 | Atwood et al. | 399/302 |

* cited by examiner

*Primary Examiner* — Sophia S Chen

(57) ABSTRACT

An apparatus including a transfer belt, an edge sensor and a belt steering roll. The transfer belt having a lateral edge and the edge sensor detecting lateral positions of the lateral edge as it passes the edge sensor. The belt steering roll controlling lateral movement of the transfer belt, which is rotatably mounted maintaining rolling engagement with the transfer belt. An axis of rotation of the belt steering roll selectively tiltable defining a steering angle with respect to an axis reference orientation. Changes in the steering angle inducing a lateral shift profile to the lateral edge. The lateral shift profile defined by changes to the lateral positions of the lateral edge during a period. The steering angle being changed based on a differential between a currently detected lateral position of a segment of the lateral edge and a predetermined lateral position derived from the lateral shift profile.

20 Claims, 5 Drawing Sheets

BELT TRACKING USING STEERING ANGLE FEED-FORWARD CONTROL

TECHNICAL FIELD

The presently disclosed technologies are directed to apparatus and methods used to reduce registration errors in a media handling device, such as marking devices, including printing system. The systems and methods described herein use feedforward belt steering control in order to compensate for repeating and measured disturbances to a transfer belt or web in a media handling device.

BACKGROUND

In media handling assemblies, particularly in printing systems, accurate and reliable registration of an image as it is transferred is desirable. In particular, accurate registration of an image as it is transferred to a target substrate media or an intermediate transfer belt has a direct correlation to image quality.

Contemporary media handling assemblies use controllers, in the forms of automated processing devices, in order to maintain control of the belts and/or sheets they are handling. Often that control is maintained by adjusting a belt velocity which conveys marking material and/or sheets of paper on transfer belts to a transfer station. Also, steering systems are used in order to guide and/or control the position of the belts along a process direction. While controlling the belt speed along the process direction is important, maintaining lateral control and stability can also be a challenge.

Many belt or web transport systems employ an actuator, in the form of a tiltable steering roll, in order to control lateral movement. The rotational axis of the steering roll is tilted in order to encourage the belt supported thereon to laterally shift. After receiving input from sensors measuring the speed and position of a belt, a controller executes a command profile in order to adjust the belt position when it has drifted from its base position. Such systems are particularly common in printing systems, but are also found in other substrate media handling assemblies.

Typically, control systems are employed to manage the operation of the marking device. Additionally, the control systems attempt to manage most disturbances that result in motion errors and thus effect image quality. One example of such control techniques is a closed-loop technique that uses feedback control. Feedback control reacts to disturbances by attempting to correct for them on the next system cycle. Closed-loop feedback control is similar to a trial-and-error based system; making a correction, measuring the results and then further correcting on the next go-around. However, as feedback control is reactionary, it tends to lag in its response and thus may not compensate fully for quick or transient disturbances.

Another known control technique is feedforward control, which uses an open-loop system that accumulates information for future use based on prior calibration and/or preliminary setup of the system. The feedforward control can eliminate the response lag and anticipate known system disturbances. However, belt steering actuators, while useful to reposition a belt, cause an induced disturbance to the belt, which can lead to belt position tracking errors. Such induced disturbances combine with the fact that most endless-loop belt systems have belt edges that are not straight and/or have inherent movement profiles that are not perfectly straight. Accordingly, attempts by feedforward control to manage a combination of inherent movement and steering induced movement errors lead to overcompensation, which translates to position errors of images.

Accordingly, it would be desirable to provide an apparatus and method capable of more accurately reducing registration errors in a media handling assembly, and thereby overcomes the shortcoming of the prior art.

SUMMARY

According to aspects described herein, there is disclosed an apparatus to reduce registration errors in a marking device. The apparatus including a transfer belt, edge sensor and belt steering roll. The transfer belt having a lateral edge, where the transfer belt moves in a process direction across a transfer zone. The edge sensor detecting lateral positions of the lateral edge as the lateral edge passes the edge sensor. The belt steering roll controlling lateral movement of the transfer belt. The belt steering roll rotatably mounted maintaining rolling engagement with the transfer belt. The belt steering roll having steering actuator. One example of a steering actuator includes a selectively tiltable axis of rotation. Adjustments by the steering actuator induce a lateral shift profile to the lateral edge of the belt. For example, tilting of the axis of rotation of a tiltable steering roll defines a steering angle with respect to a reference orientation of the axis of rotation. Changes in the steering angle inducing the lateral shift profile to the lateral edge. The lateral shift profile induced by the steering actuator is defined by changes to the lateral positions of the lateral edge during a period in response to the steering actuator adjustment. The adjustments to the steering actuator, such as changes in the steering angle, being based on a differential between a currently detected lateral position of a segment of the lateral edge and a predetermined lateral position for that segment derived from the lateral shift profile.

Additionally, the lateral shift profile can be determined by a calibration procedure, wherein the belt steering roll is tilted to a series of steering angles and the induced lateral shift profile is recorded for each of the series of steering angles. Alternatively, the lateral shift profile can be determined by adaptive tuning of a steering angle gain whereby steering angle is related to induced lateral edge movements. The steering roll can be disposed between the edge sensor and the transfer zone along an extent of the transfer belt. The transfer belt can convey a substrate media sheet thereon. Alternatively, the transfer belt can be an endless loop belt that moves in a recirculating path. Further, the transfer belt can be an image transfer belt conveying a toner image thereon. The apparatus can also include a controller receiving input based on the detected lateral positions, wherein the controller initiates the steering angle being changed. The edge sensor can be a single sensor in one location along the lateral edge, where the segment of the lateral edge is a contiguous unitary section of the transfer belt. Also, the steering angle can be changed based on feedforward control using the currently detected lateral position as an input to signal the tilting of the belt steering roll in order to adjust the lateral position of the segment of the lateral belt edge at least by the time it reaches the transfer zone. The steering actuator can include a selectively tiltable steering roll, wherein tilting of the axis of rotation of the steering roll defines a steering angle with respect to a reference orientation of the axis of rotation, wherein the adjustments to the steering actuator include changes in the steering angle.

According to other aspects described herein, there is discloses a method of reducing registration errors in a media handling system. The method include determining a lateral shift profile induced by steering angles of a belt steering roll. The belt steering roll rotatably mounted and maintaining rolling engagement with a transfer belt. The transfer belt having two opposed lateral edges and moving in a process direction across a transfer zone. The belt steering roll having a selectively tiltable axis of rotation. The steering angles each defined by an angle of tilt of the axis of rotation relative to a reference orientation of the axis of rotation. The lateral shift profile defined by lateral changes in position to one of the two opposed lateral edges in response to the steering roll being tilted to at least one of the steering angles. The method also including determining a corrective steering angle. The corrective steering angle based on a differential between a currently detected lateral position of a segment of the one lateral edge and a predetermined lateral position of the one lateral edge derived from the lateral shift profile. The method also including tilting the belt steering roll to the corrective steering angle.

Additionally, the currently detected lateral position of the method can be measured by an edge sensor detecting lateral positions of the one lateral edge as the one lateral edge passes the edge sensor. Also, the edge sensor can be a single sensor in one location along the one lateral edge, the segment of the lateral edge being a contiguous unitary section of the transfer belt. The belt steering roll tilting can be initiated prior to the segment reaching the transfer zone. Also, the lateral shift profile according to the method can be determined by a calibration procedure, wherein the belt steering roll is tilted to a series of steering angles and the induced lateral shift profile is recorded for each of the series of steering angles. Alternatively, the lateral shift profile according to the method can be determined by adaptive tuning of a steering angle gain whereby steering angle is related to induced lateral edge movements. The transfer belt can convey a substrate media sheet thereon. Also, the transfer belt can be an endless loop belt that moves in a recirculating path. Further, the transfer belt can be an image transfer belt conveying a toner image thereon. The corrective steering angle can be determination uses a feedforward control technique, wherein the feedforward control technique includes the currently detected lateral position and the predetermined lateral position as inputs to a controller, whereby an output is generated that initiates the tilting of the belt steering roll.

These and other aspects, objectives, features, and advantages of the disclosed technologies will become apparent from the following detailed description of illustrative embodiments thereof, which is to be read in connection with the accompanying drawings.

DETAILED DESCRIPTION

Figure 1:
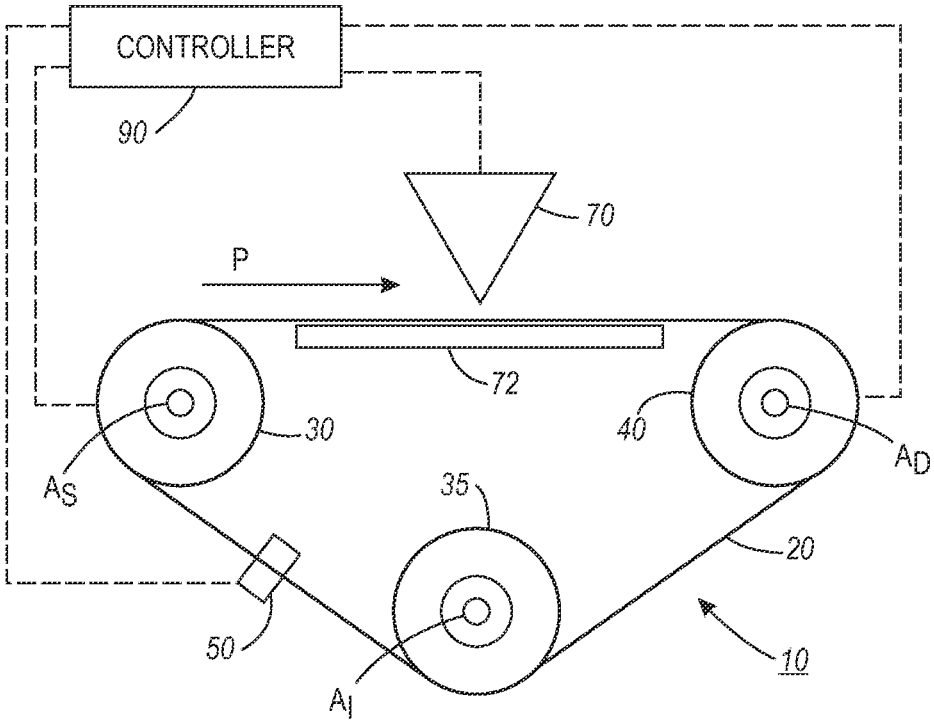
FIG. 1 shows a schematic side elevation view of a steered endless loop belt for conveying sheets of substrate media past a transfer station in accordance with aspects of the disclosed technologies.

Describing now in further detail exemplary embodiments with reference to the Figures, as briefly described above. The disclosed technologies reduce registration errors using feedforward control that subtracts previously determined belt edge position deviations from instantly measured belt edge position deviations, thereby inducing a more efficient amount of actuator response and stabilizing belt edge movement. The apparatus and methods disclosed herein can be used in a select location or multiple locations of various conventional marking device paths that include an endless loop belt. Thus, only a portion of an exemplary marking device path is illustrated herein.

As used herein, a "marking device," "printer," "printing assembly" or "printing system" refers to one or more devices used to generate "printouts" or a print outputting function, which refers to the reproduction of information on "substrate media" for any purpose. A "marking device," "printer," "printing assembly" or "printing system" as used herein encompasses any apparatus, such as a digital copier, bookmaking machine, facsimile machine, multi-function machine, and the like, which performs a print outputting function for any purpose.

Particular marking devices include printers, printing assemblies or printing systems, which can use an "electrostatographic process" to generate printouts, which refers to forming an image on a substrate by using electrostatic charged patterns to record and reproduce information, a "xerographic process", which refers to the use of a resinous powder on an electrically charged plate record and reproduce information, or other suitable processes for generating printouts, such as an ink jet process, a liquid ink process, a solid ink process, and the like. Also, a printing system can print and/or handle either monochrome or color image data.

As used herein, a "media handling assembly" refers to one or more devices used more generally for handling and/or transporting substrate media, including feeding, marking, printing, finishing, registration and transport systems.

As used herein, "substrate media" refers to, for example, paper, transparencies, parchment, film, fabric, plastic, photo-finishing papers or other coated or non-coated substrates on which information can be reproduced, preferably in the form of a sheet or web. While specific reference herein is made to a sheet or paper, it should be understood that any substrate media in the form of a sheet amounts to a reasonable equivalent thereto. Also, the "leading edge" of a substrate media refers to an edge of the sheet that is furthest downstream in the process direction.

As used herein, the term "actuator" refers to a device or assembly of elements that communicate or impart motion to another element, such as a transport handler, or directly regulates the motion of that element. In particular, an actuator is a mechanical device that accepts a data signal and performs an action based on that signal. Actuators include those mechanical devices that can impart motion to a drive wheel, a transfer belt, an imaging drum and other elements of the media handling device. Also, such motion can include tilting an idler roll for steering a belt engaged therewith.

As used herein, the term "belt" or "transfer belt" refers to, for example, an elongated flexible web supported for movement along a process flow direction. Such belts have opposed lateral edges extending generally parallel to one another. For example, an image transfer belt is capable of conveying an image in the form of toner for transfer to a substrate media. Another example includes a media transfer belt, which preferably engages and/or conveys a substrate media within a printing system. The substrate media, in the form of a sheet, may be in intimate contact with the belt through vacuum, electrostatic forces, gripper bars or other methods. Such belts can be endless belts, looping around on themselves within the printing system in order to continuously operate. Accordingly, belts move around a loop in which they circulate, such that a portion of that belt moves in a process direction of the overall assembly. A belt can engage a substrate media and/or carry an image thereon over at least a portion of the loop. Image transfer belts for carrying an image or portions thereof can include non-stretchable electrostatic or photoreceptor belts capable of accumulating toner thereon.

As used herein, the term "roll," "rollers" or "wheel" interchangeably refer to a revolving element and supporting structure. In the context of an endless loop belt system, rolls are used to support and/or drive the belt in a recirculating cycle. A drive roll is operatively driven by a motor, whereas an idler roll freely rotates. Drive rolls generally drive a belt or substrate media supported thereon. In contrast, idler rolls are driven to rotate about their longitudinal axis by the moving belt or substrate media engaged therewith.

As used herein, the term "image-bearing member" refers to one or more elements that directly engages the substrate media as it moves through at least a portion of the greater media handling assembly. Image-bearing members can carry or manipulate an image directly, such as a latent image on an imaging drum or intermediate transfer belt, or manipulate a substrate media bearing an image or intended to receive an image thereon. Image-bearing members can thus include transfer belts and other elements of the media handling device that convey or carry an image that has been applied to or is going to be applied to a substrate media.

As used herein, "sensor" refers to a device that responds to a physical stimulus and transmits a resulting impulse signal for the measurement and/or operation of controls. Such sensors include those that use pressure, light, motion, heat, sound and magnetism. Also, sensors as referred to herein can include point sensors and/or array sensors for detecting and/or measuring characteristics of a substrate media or a transfer belt, such as speed, orientation, position and disturbances from expected values. An edge sensor is a sensor that can detect or measure the position of a surface edge, such as the lateral edge of a belt or substrate media sheet. Examples of edge sensors include CCD array sensors (edge registered); long range angled Contact Image Sensors (CIS—center registered); point sensors modified to have an analog range (edge registered); moveable point sensors (center registered) or others as are common in the art. It should be appreciated that while a small rectangular shape is illustrated in the figures herein, to represent an edge sensor, almost any edge sensing device can be used to detect edge positions in accordance with the disclosed technologies.

As used herein, the terms "process" and "process direction" refer to a process of moving, transporting and/or handling a transfer belt, an image or substrate media conveyed by a transfer belt. The process direction substantially coincides with a direction of a flow path P along which a portion of the transfer belt moves and/or which the image or substrate media is primarily moved within the media handling assembly. Such a flow path P is said to flow from upstream to downstream. Accordingly, lateral or transverse directions refers to movements or directions perpendicular to the process direction and generally along a common planar extent thereof.

Figure 7:
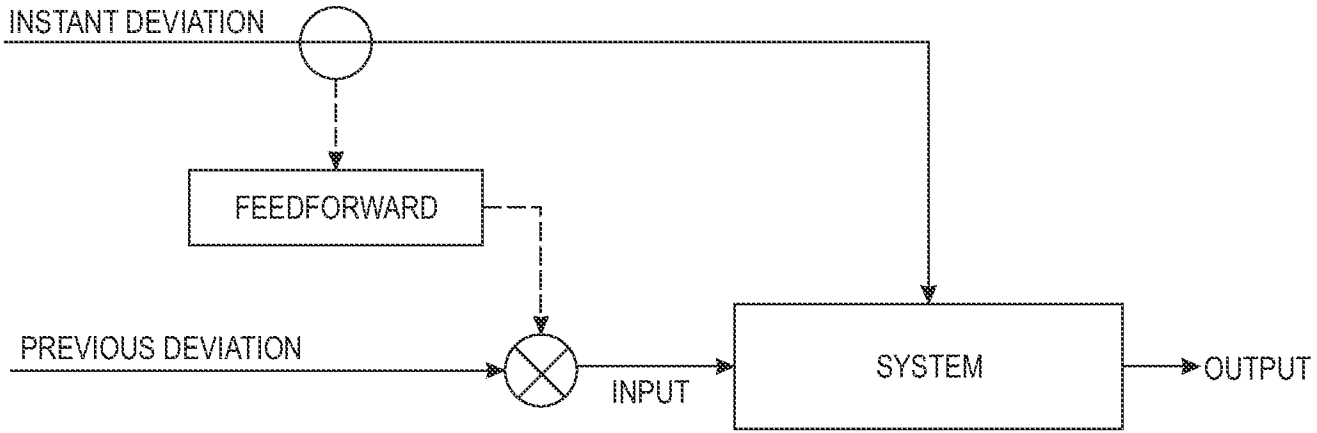
FIG. 7 shows a block diagram of a system for reducing registration errors in a marking device in accordance with an aspect of the disclosed technologies.

Feedforward control as used herein refers CPU-based automated controls that couple an input signal to a control variable. The control variable adjustment is not simply error-based, but rather is based on knowledge about the process in the form of a mathematical model and knowledge about or measurements of the process disturbances. A feedforward control system includes a means to detect a disturbance or receive an input and process that input through an algorithmic model to determine the required modification to the control action. FIG. 7 shows a simple block diagram that relates feedforward control to the apparatus and methods of the instant disclosure. Previous deviations, determined by one of various techniques, establish predetermined belt edge lateral positions relative to a base-line zero position. Input from those previous deviations is analyzed along with input from measurements of instant deviations in the form of currently detected lateral positions of the lateral belt edge. In accordance with an aspect of the disclosed technologies, a differential between these inputs is used to determine a modified input transmitted to the system, resulting in an output to the steering control that improves belt edge stability.

FIG. 1 shows a schematic representation of an apparatus 10 for reducing registration errors, including an endless loop belt 20 supported by rolls 30, 35, 40. It should be understood that a fewer or greater number of rolls can be provided to support the belt 20. In this illustrative embodiment one of the rolls is a steering actuator 30 and another roll is a drive roll 40. The additional optional roll 35 is an idler roll and represents the one or more further supporting rolls that can be used to support the endless loop belt. The position of an edge of the endless loop belt 20 is measured by an edge sensor 50. Additionally, a marking device 70 is shown for placing marking material on the endless loop belt 20 or a substrate media sheet conveyed thereon. Also, the operation of the apparatus 10 is managed by controller 90, which is operatively coupled to and controls the steering actuator 30, the drive roll 40 and the marking device 70. The controller 90 also receives input from sensors, such as the edge sensor 50.

In this exemplary embodiment, rolls 30, 35 are both idler rolls rotatably mounted to freely rotate, but roll 30 is additionally a belt steering actuator. In this way, steering actuator 30 is characterized as a soft axis belt steering roll because it is not a drive roll and the longitudinal axis of rotation $A_S$ of this roll can be adjusted in order to laterally shift the position of the endless loop belt 20 riding thereon. In this exemplary embodiment, the belt steering roll 30 can be made to tilt. By tilting the axis of rotation $A_S$ a certain amount, the belt 20 will react by shifting laterally along the longitudinal extend of the roll. The amount of tilt (measured by an angle $\alpha$) and consequently the amount of belt shift can be controlled by a motor, such as a step motor (not shown). A step motor would pivot the steering actuator axis $A_S$ in predefined increments with respect to the base-line position of that axis $A_S$. Thus, the base-line position provides a fixed line of reference for steering roll axis of rotation and thus the steering actuator. Alternatively, a DC motor, AC Motor, hydrostatic drive or other actuators could be used. Also, the actuator can optionally include gears, belts or other known means of transmission. Further, a power amplifier can be employed that provides actuation power for the actuator through amplification (and sometimes conversion) of a low power control signal. Moreover, a conventional servo controller can be used to control velocity of the transport media by means of outputting a control signal to the power amplifier to drive the respective motor.

While steering actuator 30 is illustrated as a tiltable steering roll, other steering actuators can be used in accordance with the disclosed technologies. For example, the steering actuator can alternatively be a laterally shifting belt steering roll. In this way lateral belt position correction controls can be applied through a gentle lateral force applied to one of the lateral edges of the belt. Such a transverse force is applied to adjust the lateral position of the belt. Such an alternative apparatus and system is disclosed in U.S. Pat. No. 6,594,460 by Lloyd A. Williams et al., which is incorporated herein by reference and which is commonly assigned with the instant disclosure.

Roll 40 is a drive roll that is rotatably driven by a motor assembly (not shown) coupled thereto by gears, belts, pulleys or other known methods (also not shown). The drive roll 40 imparts a velocity to the belt 20 generally in a process direction P. In contrast, the axis of rotation of the lower idler roll 35 and the drive roll 40 are each fixed and thus remain parallel to one another.

The belt edge sensor 50 is shown to be disposed just upstream of the steering actuator 30 with relation to the path of the endless loop belt 20. This position is advantageous so that corrections to the belt edge position can be made by the steering actuator 30 prior to a measured portion of belt reaching the marking device 70 at the transfer station just downstream of the steering actuator. However, the location of the belt edge sensor sometimes is determined or dictated by available space. Nonetheless, for best control performance, a location close to the steering roll is proffered.

For exemplary purposes, the marking device 70 shown in FIG. 1 also employs a corresponding support platen 72. The platen 72 supports the belt 20 as it passes the marking device 70. The zone where the belt 20, or a substrate media sheet supported thereon, receives marking material from the marking device 70 is referred to as a transfer station. It should be understood that the platen 72 could be part of a vacuum plenum for forcing the belt 20 into intimate contact with the plenum surface as the belt passes. When using a vacuum plenum, Where the endless belt 20 carries a substrate media sheet, holes in the belt 20 allow the vacuum force from a vacuum plenum to hold down each sheet conveyed thereon. Sheets are fed onto the belt 20 near the steering roll 30; the vacuum forces the sheet into intimate contact with the belt 20 and forces the belt 20 into intimate contact with the plenum platen surface 72. Above the platen 72, on the opposed side of the belt 20 is at least one transfer station 70. A drive motor moving the drive roll 40 propels the belt 20 and an encoder attached to the drive roll can measure the speed of the drive roll 40. The force of vacuum that holds the belt 20 down on the plenum 72 is substantial and increases the normal force and thus the drag force in the area covered by the sheet. These are further forces that should be considered along with other elements that effect the movement of the belt 20, as measured from the belt edge 25.

The marking device 70 can take the form of almost any type of marking device used in printing systems. For example the marking device 70 can be an ink jet assembly or use xerographic imaging with a photoreceptor or intermediate belt. One common marking device forms an image using toner. The toner image is directly transferred on to and fixed on a substrate sheet or temporarily transferred to the endless-loop belt 20 and is thereafter transferred to a substrate. The marking device 70 engages and/or interacts with the belt or sheet in an image transfer zone, also referred to herein as an image transfer station or just transfer station. Transfer of the image to the belt 20 or a sheet should be in precise registration, otherwise it can cause processing interruptions or delays and/or impair the print quality.

Often, marking material is built-up in stages by having the sheet or target section of belt 20 pass through more than one transfer station. For example, in a "highlight color" printing apparatus, where it desired to print black plus one other predetermined color, a typical arrangement is to have a black development unit transfer its portion of the image at one stage and one or more other development units (one for each of a selectable set of highlight colors, only one of which would be used) to transfer its portion of the image at another stage. In the case of a full-color printing apparatus, there are typically four development units; cyan, magenta, yellow, and black (CMYK) and thus four transfers in order to create a full-color image. Other types of architecture include "hexachrome," where there are two additional color development units beyond CMYK, thus providing an extended color gamut for the printer; and arrangements that include a development unit for applying clear toner, or one applying a toner with special properties such as MICR (magnetic ink character recognition) toner. Accordingly, it should be understood that although FIG. 1 only illustrates one marking device 70, additional devices with corresponding transfer stations can be employed in accordance with aspects of the disclosed technologies.

Figure 2:
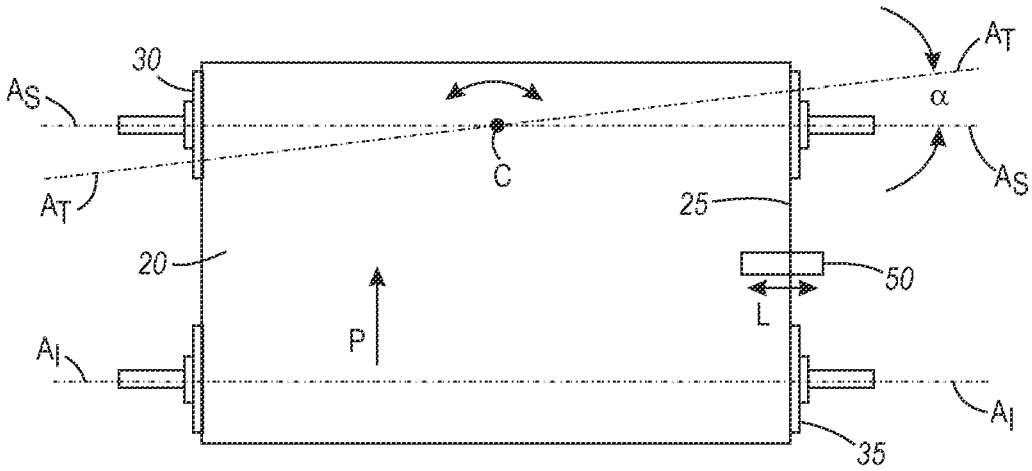
FIG. 2 shows a schematic front elevation view of the steered endless loop belt of FIG. 1, looking down-stream in a process direction, in accordance with aspects of the disclosed technologies, but not showing the transfer station.

FIG. 2 also shows the endless loop belt 20 and two of the rolls 30, 35 of FIG. 1, without the marking station 70 or controller 90 for illustration purposes. The front elevation view of FIG. 2 looks in a downstream direction, thus the drive roll 40 is not visible because it is positioned behind the steering roll 30. FIG. 2 shows the lateral direction L measured by the edge sensor 50. It should be understood that the edge sensor can measure either side of the belt, as desired, and can alternatively be disposed in a different position along the process direction P of the belt 20. FIG. 2 also illustrates an example of how the rotational axis of steering actuator 30 can be tilted. In a non-tilted base position the steering actuator axis $A_S$ is parallel to the axis $A_I$, $A_D$ of the other rolls (the axis of rotation of the idler roll 35 and the drive roll 40 generally remain parallel to one another). The steering actuator axis $A_S$ can be made to tilt (pivot) a number of degrees $\alpha$ from that base position, thus illustrated in the tilted position as axis $A_T$. It should be understood that this change in the angular orientation of the steering actuator axis $A_S$ can in the opposite direction to that shown. Also, the steering actuator axis $A_S$ need not be pivoted about a center (C) of the steering roll 30. For example, the pivot can be centered at one axial end of the roll or other point as is known in the art.

The induced lateral movement of the belt 20 at the location of the belt edge sensor 50 is a function of the steering actuator adjustments. Thus, in the tiltable steering roll embodiment disclosed herein the steering actuator adjustments would mean changes in the angle $\alpha$ of the orientation of the axis of rotation of the belt steering roll. This function is also referred to herein as a "lateral shift profile" and can be calculated, calibrated or found by trial and error. Hence the induced belt edge variation due to the steering angle and other regular system disturbances can be determined ahead of time and used by the system controller 90. Every system has its own peculiar quirks, but preliminary calibration or measurement of repeating disturbances can be used as a natural base line movement profile for the belt 20, and more particularly the measured belt edge 25. What is more, that lateral shift profile can be further correlated to each incremental change in the steering actuator angle α. Thus, any particular point or segment along the belt edge 25, will have a previously determined belt edge position deviation in accordance with the lateral shift profile.

After the initial setup or calibration of the apparatus 10, then the edge sensor 50 continues to be used to detect an current lateral position deviation of a measured portion of the belt edge 25. In accordance with an aspect of the disclosed technologies, the previously determined belt edge position deviation is subtracted from that current lateral position deviation detected by the edge sensor during the current belt loop cycle. The resulting differential is then used to determine the necessary angular correction to induce with the belt steering actuator, rather than simply using the total instant measured belt edge deviation that would result in overcorrection. The result is a greatly reduced amount of variation in the steering roll angle with resulting improvement in tracking and registration. Advantages over other methods is the immediate improvement in performance as compared to have to wait a few belt revolutions and reduced cost.

Hence the methods in accordance with the disclosed technologies include initially determining a preliminary or calibration cycle displacement profile. The preliminary displacement profile representing a repeating belt edge displacement on a steered endless loop belt. The repeating belt edge displacement being correlated to segments along the length of the endless loop belt. That preliminary displacement profile defining a previously determined belt edge displacement. Additionally, a relation can be derived between the steering angle position of a steering actuator and the induced edge variation. This relation can be derived from either a calibration procedure or by developing a profile defining the preliminary value displacement. The calibration procedure can be performed by varying the steering angle of the steering actuator and recording the induced edge variation at the sensor location. Alternatively, this relation can be based on a model that uses roller positions, edge sensor location, belt spans, etc. to calculate the linear relation between steering roll position and induced edge position using simple geometry. As a further alternative, adaptive tuning of a gain that relates induced edge position from steering roll angle can be used to define the preliminary displacement profile. Adaptive tuning is a contemporary control method that generally employs a controller, where the controller adapts to a controlled system with parameters which vary, or are initially uncertain.

The determination of the angular position of the steering roll can be derived from either an angular position measurement sensor or based on a derived model. The model can be derived using many steering systems have a stepper motor driven cam that changes the steering angle. The total step count is proportional to the cam position, which together with the cam profile determines the angular position of the steering roll. In many cases the cam is linear, resulting in a linear relation between step count and angular position of the steering roll. For other steering system configurations, appropriate models can be derived.

Once the preliminary displacement profile is obtained, then instantaneous measurements of the belt edge displacement continue to be taken by a single belt edge sensor. The instantaneous measurements should be correlated to a particular segment of the endless loop belt. Any one particular instantaneous measurement will represent the belt edge displacement of a particular segment of the endless loop belt. In accordance with the disclosed technologies, a previously determined belt edge displacement value is derived from the preliminary displacement profile for the particular measured segment of the belt edge. That previously determined belt edge displacement value is subtracted from the instantaneous measurement in order to determine a differential displacement value. Thereafter, the differential displacement value is used as the error signal for the steering actuator.

Figure 3:
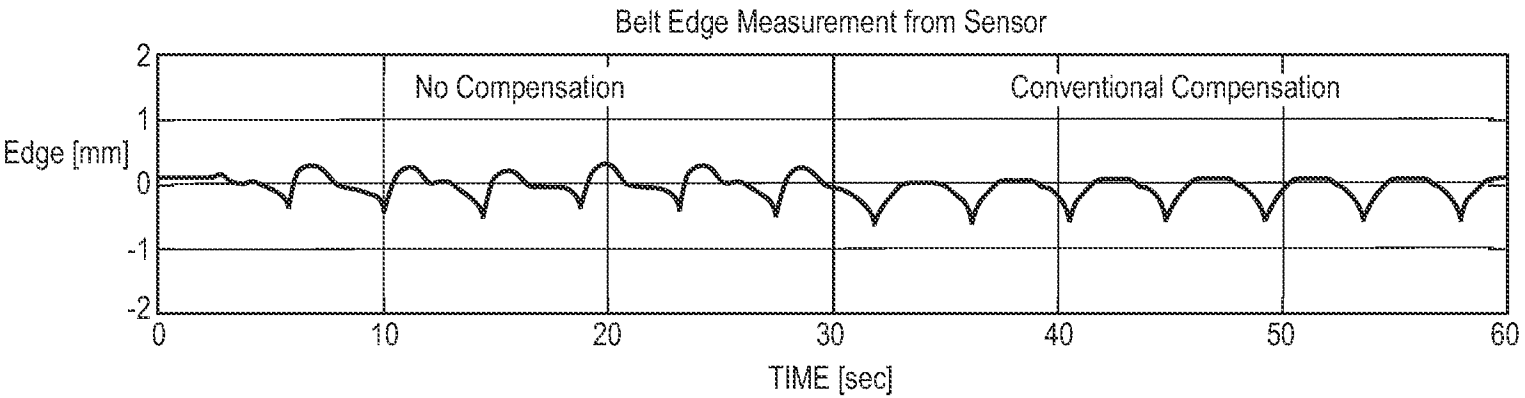
FIG. 3 shows a graphical representation of belt edge position deviations over time, with steering initiated after the first 30 seconds using traditional feedforward compensation, but without differential feedforward compensation.
Figure 4:
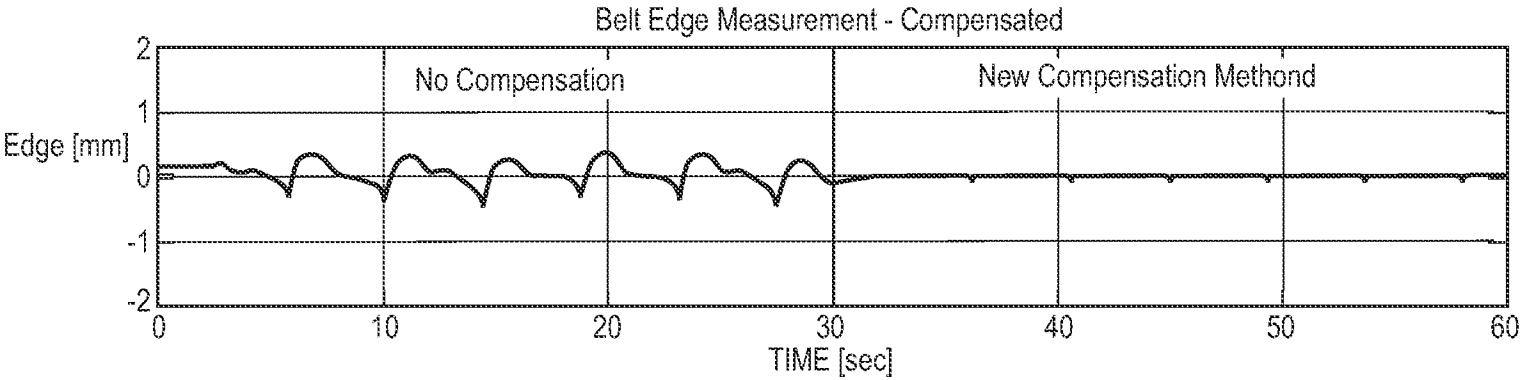
FIG. 4 shows a graphical representation of belt edge position deviations over time, with steering initiated after the first 30 seconds with differential feedforward compensation applied, in accordance with aspects of the disclosed technologies.

FIGS. 3 and 4 illustrate the tracking performance over time of belt edge position, measured by a single belt edge sensor. The values shown in the graphs of FIGS. 3 and 4 are provided for illustrative purposes only. These values were derived using an adaptive tuning gain method. An optimal gain was selected manually after several iterations (belt loop cycles). The first part of the FIGS. 3 and 4, between zero and thirty seconds shows belt edge displacement that represents a lateral shift profile, with no compensation for belt edge tracking control. Without compensation the first thirty seconds of the graphs in FIGS. 3 and 4 are the same. The second half of the graphs in FIGS. 3 and 4, between thirty and sixty seconds, distinguish conventional tracking correction methods from those in accordance with aspects of the disclosed technologies. FIG. 3 shows conventional compensation based on the total belt edge displacement error. As shown, even though steering angle changes are being made in attempt to compensate for belt edge movement, the belt edge continues to displace considerably using conventional methods. In contrast, FIG. 4 illustrates have using the methods in accordance with aspects of the disclosed technologies the variation in compensated belt edge displacement is greatly reduced. The method applied in the second half of the graph in FIG. 4 subtracts from the current belt edge measurement the previously determined lateral movement of the belt derived from the lateral shift profile, which identify a baseline movement profile for the system.

Figure 5:
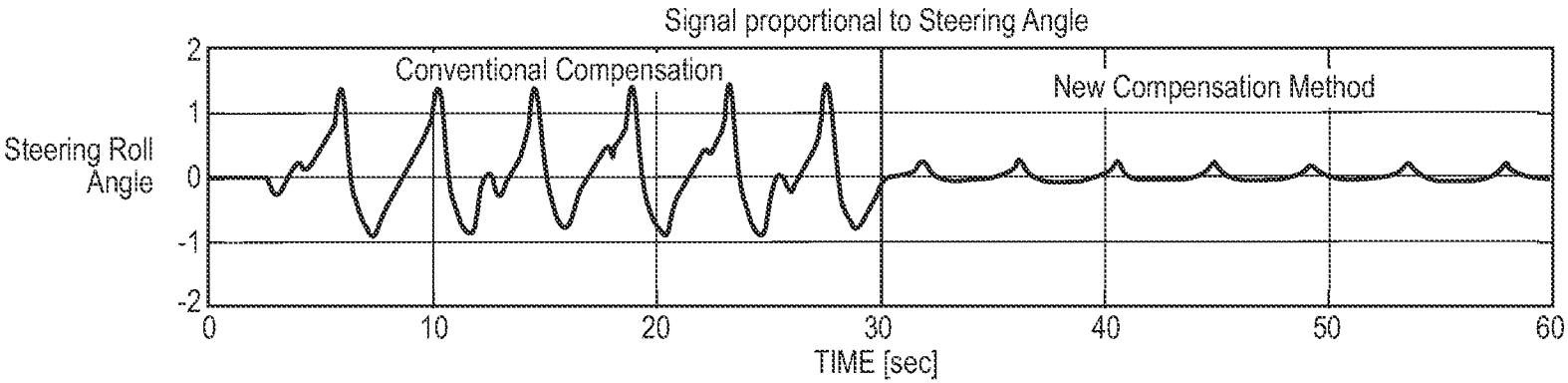
FIG. 5 shows a graphical representation of steering roll angle deviations over time, with conventional steering compensation used in the first 30 seconds and with differential feedforward compensation applied in accordance with aspects of the disclosed technologies after the first 30 seconds.

FIG. 5 shows the value of the steering roll angle α over time. The steering roll angle value shown is proportional to the step count of the stepper motor used to actuate the steering roll. The first thirty seconds in FIG. 5 reflect the drastic angular changes made to the steering roll using conventional steering compensation techniques as similarly applied to the second thirty second of the graph in FIG. 3. The second thirty seconds in FIG. 5 reflect the greatly minimized angular changes to the steering roll that are needed using the new compensation techniques in accordance with aspects of the disclosed technologies.

Thus, the graphs represented in FIG. 3-5 reflect the advantages of the belt edge deviation compensation method in accordance with the disclosed technologies herein. The apparatus and methods disclose herein provide more accurate tracking control resulting in improved registration, do not require extra edge sensors (since results are achievable using a single edge sensor) and the improvements and stability the endless loop belt edge position is immediately evident.

Figure 6:
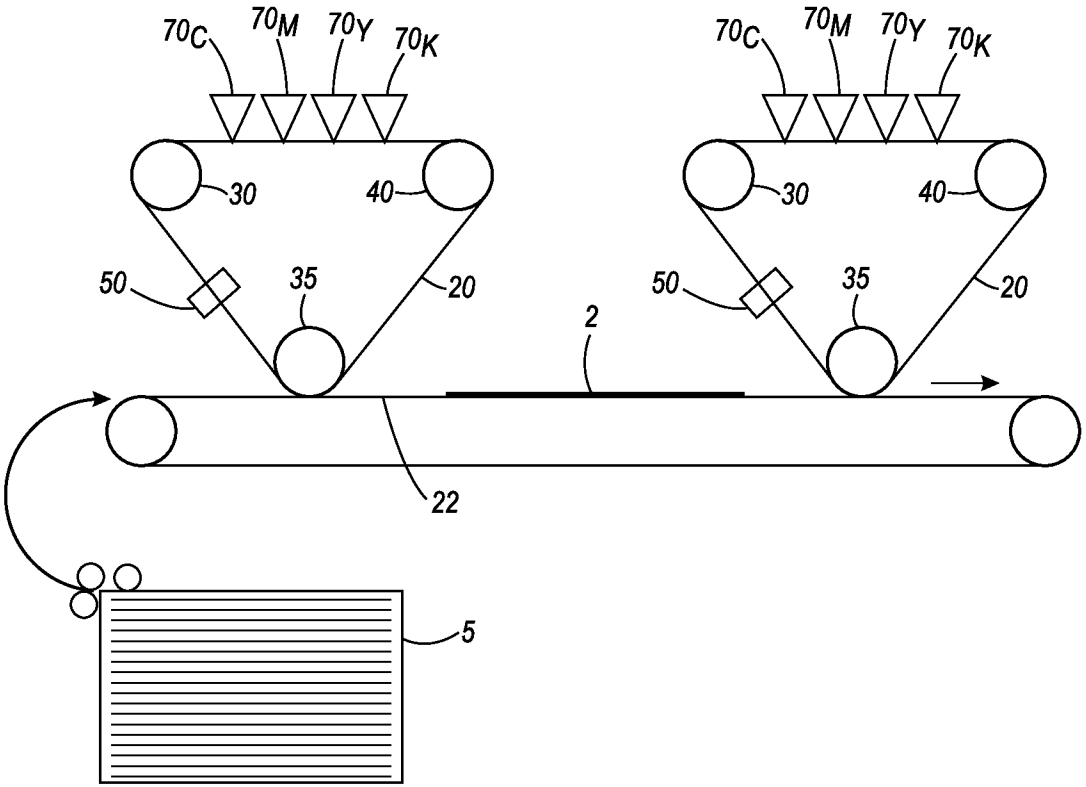
FIG. 6 shows a schematic side elevation view of two steered endless loop belts, each serving as intermediate transfer belts for conveying marking material to a transport belt conveying sheets of substrate media, in accordance with an aspect of the disclosed technologies.

FIG. 6 shows a schematic side elevation view of two separate steered endless loop belts 20, each serving as intermediate transfer belts for conveying marking material to a transport belt 22 conveying sheets of substrate media 2 from a sheet supply 5, in accordance with an aspect of the disclosed technologies. This embodiment reflects how the belt steering described above, can be applied to systems with different marking engines and configurations. Each of the endless loop belts 20 include a steering actuator 30, drive roll 40, a single belt edge sensor 50, a supplemental idler 35 and this time each belt includes four marking stations $\mathbf{70}_C$, $\mathbf{70}_M$, $\mathbf{70}_Y$, $\mathbf{70}_K$. Each of the marking stations apply a different color to the intermediate belts 20.

It should be understood that the apparatus and method of reducing registration errors as described herein, can be combined with other forms of registration actuators, sensors and control parameter optimization methods to deliver high performance results. Additionally, in accordance with further aspects of the disclosed technologies herein, the belt steering function can be handled by a common controller 90 that works for more than one media handling assembly. Often media handling assemblies, and particularly printing systems, include more than one module or station. Accordingly, more than one registration apparatus as disclosed herein can be included in an overall media handling assembly. Further, it should be understood that in a modular system or a system that includes more than one registration apparatus, the measured disturbance signals can be relayed to a central processor for controlling registration. In this way, particularly in a modular system, one module can learn from the earlier module to further improve the overall media handling. Thus, each sheet passing through a module can be considered a cycle and the number of modules representing that many cycles from which information can be learned regarding the transport handler movements. In this way, the learning system can converge on the ideal signal profile more quickly.

It will be appreciated that various of the above-disclosed and other features and functions, or alternatives thereof, may be desirably combined into many other different systems or applications. It will also be appreciated that various presently unforeseen or unanticipated alternatives, modifications, variations, or improvements therein may be subsequently made by those skilled in the art which are also intended to be encompassed by the disclosed embodiments and the following claims.

What is claimed is:

1. An apparatus to reduce registration errors in a marking device, the apparatus comprising:

a transfer belt having a lateral edge, the transfer belt moving in a process direction across a transfer zone;

an edge sensor to detect lateral positions of the lateral edge as the lateral edge passes the edge sensor; and a steering actuator including a belt steering roll having a longitudinal axis of rotation that is angularly adjustable in order to laterally shift a position to control lateral movement of the transfer belt along an axial extent of the axis of rotation of the belt steering roll, the belt steering roll rotatably mounted maintaining rolling engagement with the transfer belt, adjustments to lateral positions of the transfer belt by the steering actuator inducing a lateral shift profile to the lateral edge, the lateral shift profile defined by changes to the lateral positions of the lateral edge during a period in response to a change in angle of the longitudinal axis of the belt steering roll, the belt steering roll angle being adjusted based on a differential between a currently detected lateral position of a segment of the lateral edge and a predetermined lateral position derived from the lateral shift profile.

2. The apparatus of claim 1, wherein the lateral shift profile is determined by a calibration procedure, wherein an orientation of the axis of rotation of the belt steering roll is incrementally changed and the induced lateral shift profile is recorded for each of the incremental changes.

3. The apparatus of claim 1, wherein the lateral shift profile is determined by adaptive tuning of the steering actuator, whereby steering actuator changes are related to induced lateral edge movements.

4. The apparatus of claim 1, wherein the steering roll is disposed between the edge sensor and the transfer zone along an extent of the transfer belt.

5. The apparatus of claim 1, wherein the transfer belt conveys a substrate media sheet thereon.

6. The apparatus of claim 1, wherein tilting of the axis of rotation of the steering roll defines a steering angle with respect to a reference orientation of the axis of rotation, wherein the adjustments to the steering actuator include changes in the steering angle.

7. The apparatus of claim 1, wherein the transfer belt is an image transfer belt conveying a toner image thereon.

8. The apparatus of claim 1, further comprising:

a controller receiving input based on the detected lateral positions, wherein the controller initiates the steering angle being changed.

9. The apparatus of claim 1, wherein the edge sensor is a single sensor in one location along the lateral edge, the segment of the lateral edge being a contiguous unitary section of the transfer belt.

10. The apparatus of claim 1, wherein the steering actuator adjustment is changed based on feedforward control using the currently detected lateral position as an input to signal the steering actuator adjustment in order to adjust the lateral position of the segment of the lateral belt edge at least by the time it reaches the transfer zone.

11. A method of reducing registration errors in a marking device, the method comprising:

determining a lateral shift profile induced by steering angles of a belt steering roll, the belt steering roll rotatably mounted and maintaining rolling engagement with a transfer belt, the transfer belt having two opposed lateral edges and moving in a process direction across a transfer zone, the belt steering roll having a selectively tiltable axis of rotation, the steering angles each defined by an angle of tilt of the axis of rotation relative to a reference orientation of the axis of rotation, the lateral shift profile defined by lateral changes in position to one of the two opposed lateral edges in response to a change in at least one of the steering angles;

determining a corrective steering angle, the corrective steering angle based on a differential between a currently detected lateral position of a segment of the one lateral edge and a predetermined lateral position of the one lateral edge derived from the lateral shift profile; and tilting the belt steering roll to the corrective steering angle.

12. The method of claim 11, wherein the currently detected lateral position is measured by an edge sensor detecting lateral positions of the one lateral edge as the one lateral edge passes the edge sensor.

13. The method of claim 12, wherein the edge sensor is a single sensor in one location along the one lateral edge, the segment of the lateral edge being a contiguous unitary section of the transfer belt.

14. The method of claim 11, wherein the belt steering roll tilting is initiated prior to the segment reaching the transfer zone.

15. The method of claim 11, wherein the lateral shift profile is determined by a calibration procedure, wherein the belt steering roll is tilted to a series of steering angles and the induced lateral shift profile is recorded for each of the series of steering angles.

16. The method of claim 11, wherein the lateral shift profile is correlated to each incremental change in the steering roll angles.

17. The method of claim 11, wherein the transfer belt conveys a substrate media sheet thereon.

18. The method of claim 11, wherein the transfer belt is an endless loop belt that moves in a recirculating path.

19. The method of claim 11, wherein the transfer belt is an image transfer belt conveying a toner image thereon.

20. The method of claim 11, wherein the corrective steering angle determination uses a feedforward control technique, wherein the feedforward control technique includes the currently detected lateral position and the predetermined lateral position as inputs to a controller, whereby an output is generated from the controller that initiates the tilting of the belt steering roll.

* * * * *